US006834785B2

(12) United States Patent
Kneth

(10) Patent No.: US 6,834,785 B2
(45) Date of Patent: Dec. 28, 2004

(54) DEVICE FOR PULLING ON SOCKS

(76) Inventor: Helmut Kneth, Neustift 37, Schönberg (AT), A 3562

( * ) Notice: Subject to any disclaimer, the term of this patent is extended or adjusted under 35 U.S.C. 154(b) by 0 days.

(21) Appl. No.: 10/479,263

(22) PCT Filed: May 29, 2002

(86) PCT No.: PCT/AT02/00163

§ 371 (c)(1),
(2), (4) Date: Dec. 1, 2003

(87) PCT Pub. No.: WO02/096249

PCT Pub. Date: Dec. 5, 2002

(65) Prior Publication Data

US 2004/0173647 A1 Sep. 9, 2004

(30) Foreign Application Priority Data

Jun. 1, 2001 (AT) ..... GM447/2001

(51) Int. Cl.[7] ..... A47G 25/90
(52) U.S. Cl. ..... 223/112
(58) Field of Search ..... 223/112, 111

(56) References Cited

U.S. PATENT DOCUMENTS 2,894,669 A * 7/1959 Silken ..... 223/111
2,903,170 A * 9/1959 Ahn ..... 223/111
2,919,840 A 1/1960 Hoagland
3,604,604 A * 9/1971 Ahn ..... 223/111
4,482,084 A 11/1984 Beskin
5,050,783 A * 9/1991 Hunter ..... 223/112
5,706,988 A 1/1998 Moore

FOREIGN PATENT DOCUMENTS

| | | |
|---|---|---|
| DE | 8627221.7 | 1/1987 |
| DE | 19837924 | 3/1999 |
| DE | 19803503 | 8/1999 |
| DE | 198 30 277 | 1/2000 |

* cited by examiner

*Primary Examiner*—John J. Calvert
*Assistant Examiner*—James G Smith
(74) *Attorney, Agent, or Firm*—Collard & Roe, P.C.

(57) ABSTRACT

An apparatus is described for putting on a stocking with a frame (1) comprising two longitudinal rods (2) which are provided at one upper end with handles (11) and with U-shaped stretching member (3) for receiving the stocking between the lower ends of the longitudinal rods (2). In order to provide advantageous costructional conditions it is proposed that the stretching member (3) which is rigidly connected with the longitudinal rods (2) is associated with a clamping device which consists of two actuating rods (4) which are displaceable along the longitudinal rods (2) against the clamping force of locking springs (8) and which are joined above the stretching member (3) by a clamping member (5) cooperating with the stretching member (3).

9 Claims, 3 Drawing Sheets

DEVICE FOR PULLING ON SOCKS

RELATED APPLICATIONS

Applicants claim priority under 35 U.S.C. §119 of AUSTRIAN Application No. GM447/2001 filed on Jun. 1, 2001. Applicants also claim priority under 35 U.S.C. §365 of PCT/AT02/00163 filed on May 29, 2002. The international application under PCT article 21(2) was not published in English.

1. Field of the Invention

The invention relates to an apparatus for putting on a stocking with a frame made of two longitudinal rods which are provided at one upper end with handles and with a U-shaped stretching member for receiving the stocking between the lower ends of the longitudinal rods.

2. Description of the Prior Art

In order to help people who are impaired in their movement to put on stockings, especially in the form of socks or footless hose, differently configured aids were proposed to assist them to put on such garments, which aids are based on opening the stocking with the help of a stretcher, so that the opened stocking can be pulled with the help of a handle attached to the stretcher over the foot. For this purpose it is known (DE 198 37 924 A1) to provide a ladder-like frame which carries at its lower end a stretching ring for receiving the stocking. The disadvantageous aspect in such closed stretching rings is however that the foot needs to be guided through the stretching ring when putting on the stocking, which renders handling more difficult since the foot needs to be pulled out of the stretching ring again after putting on the stocking. Similar disadvantages also occur in other known stocking aids (DE 198 03 503 A1) in which the stretcher for receiving the stocking consists of two frame parts which are moved apart after inserting the stocking for the purpose of stretching the same. In this case too it is necessary that the foot needs to be threaded in and out between the frame parts.

Better handling conditions are obtained when a U-shaped stretching member is used for the stocking (U.S. Pat. No. 5,706,988 A), so that after putting on the stocking and the detachment of the stocking from the stretching member the foot is released by the stocking aid. The articulated connection of said U-shaped stretching member with two longitudinal rods which are only connected via the stretching member renders the handling of said stocking aid more difficult. Apart from this, the latching teeth which are provided on the stretching member and are outwardly inclined are unsuitable to secure the stocking in a careful fashion prior to the withdrawal from the stretching member when a respective tensile stress occurs on the stocking when it is put on.

In order to ensure a secure stretching of a stocking on a U-shaped holding means of a stocking aid, it is further known (DE 198 30 277 A1) to hold the stocking with the help of piercing tips, which stocking is stretched between two lateral legs and a heel tongue in the region of its opening and which piercing tips are held pivotably in the side legs and can be actuated by way of a cable pull which is guided within a handle pipe projecting up from a base frame to an actuating lever. The disadvantageous aspect in this known construction is that apart from the constructional effort the tips which pierce the stocking in the region of the rubber band will lead to damage to the stocking at least after longer use of the stocking aid. This does not change in any way when the piercing tips are replaced by stretching levers which pull the stocking into recesses in the side legs.

It is finally known (U.S. Pat. No. 5,050,783 A) to clamp the stocking to be applied between a stretching member and a clamping member of a clamping device, with the stretching member being fastened in a central way on a hollow handle rod, whereas the clamping member is held by an actuating rod adjustable within the handle rod, which actuating rod is supported by way of an opening spring on the face side of the handle rod. As a result of this design, the actuating rod needs to be inserted into the handle rod against the spring force by way of a handle grip which is arranged at its end projecting beyond the handle rod and held in said clamping position, which renders the handling of such a stocking aid considerably more difficult, especially when it needs to be considered that the handle rod extending in the heel region makes slipping on the stocking substantially more difficult because the handle rod needs to be guided behind the bent leg in the sitting position.

SUMMARY OF THE INVENTION

The invention is thus based on the object of configuring an apparatus for putting on a stocking of the kind mentioned above with simple constructional means in such a way that a secure slipping on of the stocking over the foot can be ensured without any damage occurring to the stocking and with ease of handling.

The invention achieves this object in such a way that the stretching member is part of a clamping device which consists of two clamping parts, namely the lower stretching member and an upper clamping member cooperating with the lower stretching member, and that one clamping part mutually connects the two longitudinal rods and the other of the two claiming parts mutually connects two actuating rods which are displaceable along the longitudinal rods against the force of a spring.

As a result of the rigid connection of the two longitudinal rods by one of the two clamping parts of the clamping device, not only a simple robust construction is achieved in combination with the U-shaped stretching member for receiving the stocking, but also advantageous handling is ensured because a substantially unhindered movement of the stocking as received by the clamping device is enabled while the stocking is being put on through the longitudinal rods which are guided on either sides of the leg which is bent in the sitting position. Since the clamping device is actuated via actuating rods which are guided along the longitudinal rods and between which the second clamping part is held, favorable clamping conditions can be achieved with a comparatively low amount of force without having to fear any impairment of handling by the actuating drive for the clamping device.

For the purpose of simply slipping the stocking over the stretching member, the arrangement of the clamping member above the stretching member is necessary, which clamping member cooperates with the stretching member. This fact can be taken into account very easily in such a way from a constructional viewpoint that the actuating rods which are held in a displaceable fashion in the hollow longitudinal rods carry the stretching member between their lower ends which project beyond the longitudinal rods, so that the longitudinal rods can be connected via the clamping members.

The actuation of the clamping device via the actuating rods can be provided in an advantageous manner with respect to its construction when the longitudinal rods and the actuating rods are provided on the side averted from the opening of the U-like stretching member with transversally aligned handle parts which are associated in pairs to a handle for actuating the clamping device. Said handle parts merely need to be adjusted relative to one another against the force of the springs which pressurize the actuating rods, which can be executed with a substantially natural posture of the hand due to the association in pairs of the handle parts to a handle.

The spring pressurization of the actuating rods can occur in the closing or opening sense. When locking springs are used, simple constructional conditions are obtained when the locking springs enclose an end section of the actuating rods which projects beyond the upper end of the longitudinal rods and rest on the face side of the longitudinal rods. Since the clamping of the stocking must occur on the stretching member from above so as not to impair the stretching of the stocking on the stretching member from below, the clamping of the stocking on the stretching member is achieved in such a way that the locking springs displace the actuating rods upwardly along the longitudinal rods, so that the stretched stocking is clamped tightly between the stretching member and the clamping member. In this clamping position a tensile force which is required for putting on the stocking can be exerted on the longitudinal rods via the handles because said tensile force acts especially on the lower handle parts which are associated with the longitudinal rods. Once the clamping of the stocking is released by having the handle parts move towards each other against the force of the locking spring after the stocking has been put on, the stocking is released. The frame can then be removed unhindered from the leg.

In order to allow pulling a stocking in an unhindered fashion from the clamping device which is spring-loaded in the closing direction over the stretching member, the clamping device can be locked in the opened position. For this purpose a latching device made of resilient hooks which are held on the longitudinal rods can be provided which engage in a latching recess of the actuating rod.

If the actuating rods are pressurized by opening springs, the handle parts belonging to the actuating rods should be arranged below the handle parts of the longitudinal rods, so that the clamping device is closed automatically in the case of a tensile load via the handles. The automatic opening of the clamping device via the opening springs allows omitting a latching device for the opened position.

In order to ensure that the frame not only ensures support in putting on a stocking but also in taking off a stocking, the two longitudinal rods can carry a U-shaped connecting member at a distance above the clamping member and opposite of the same. A downwardly facing driver is provided in the centre of said connecting member which is used as a removal aid for the stocking. Said additional connecting member does not obstruct putting on the stocking because it comes to lie on the side of the shinbone when the stocking is being put on and it allows a free movement of the frame to the front. For the purpose of removing the stocking the driver can be introduced on the calf side of the leg into the stocking in order to then remove the stocking from the foot via the heel. Another possibility for creating a removal aid is obtained in such a way that a downwardly facing driver is arranged as a removal aid for the stocking on the stretching member or clamping member in the region of a web mutually connecting the two member legs. Said driver which extends in the longitudinal direction of the lower leg does not impair slipping the stocking over the foot due to its alignment along the lower leg0.

In order to ensure an advantageous alignment of the stretching member relative to the foot, the stretching member and the clamping member can extend in an upwardly inclined manner relative to the longitudinal rods and the actuating rods, as a result of which the foot posture projecting from the lower leg is taken into account when a stocking is put on.

BRIEF DESCRIPTION OF THE DRAWINGS

The subject matter of the invention is shown in closer detail in the drawings, wherein.

DESCRIPTION OF THE PREFERRED EMBODIMENTS

Figure 1:
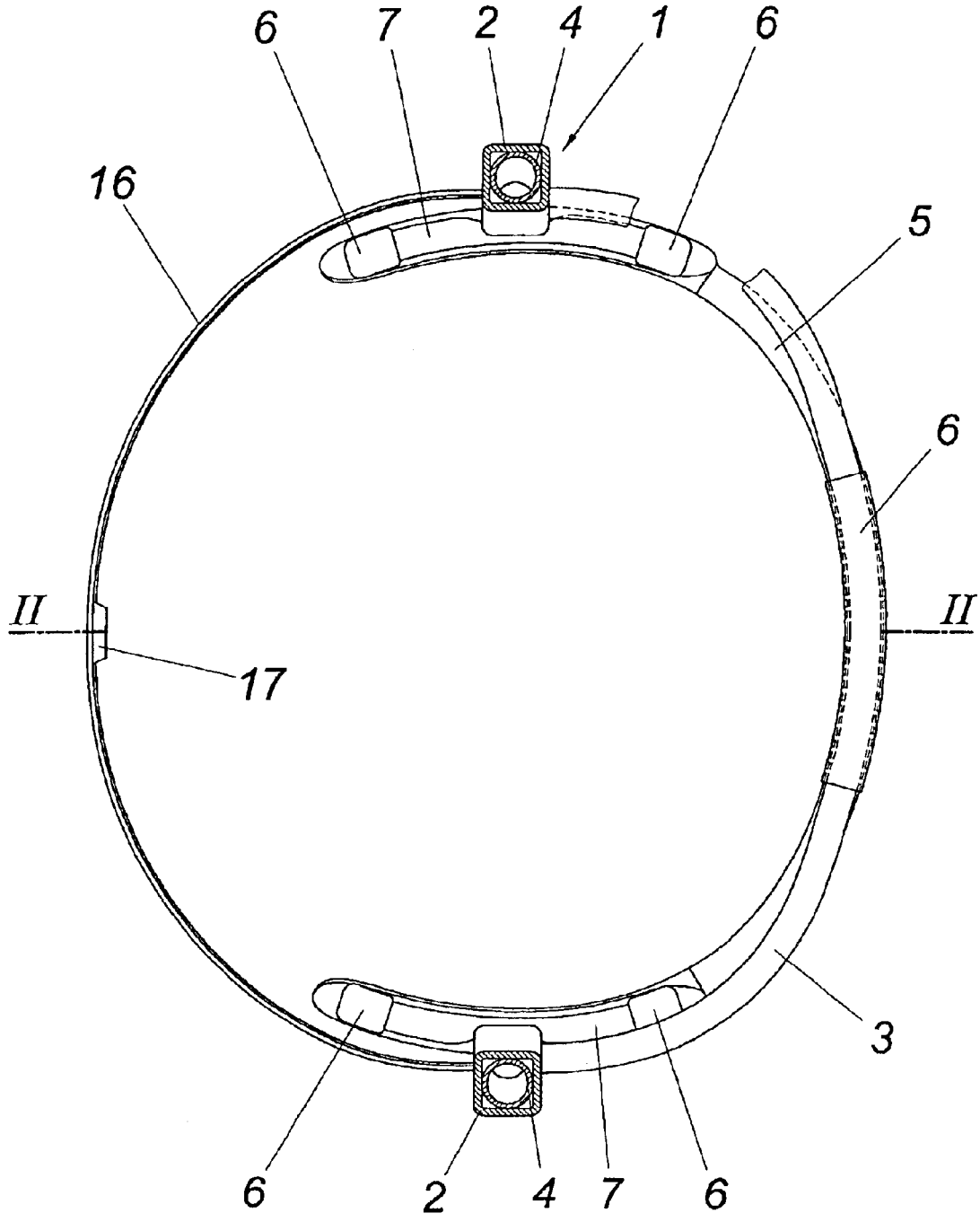
FIG. 1 shows an apparatus in accordance with the invention in a sectional view transversally to the longitudinal rods.
Figure 2:
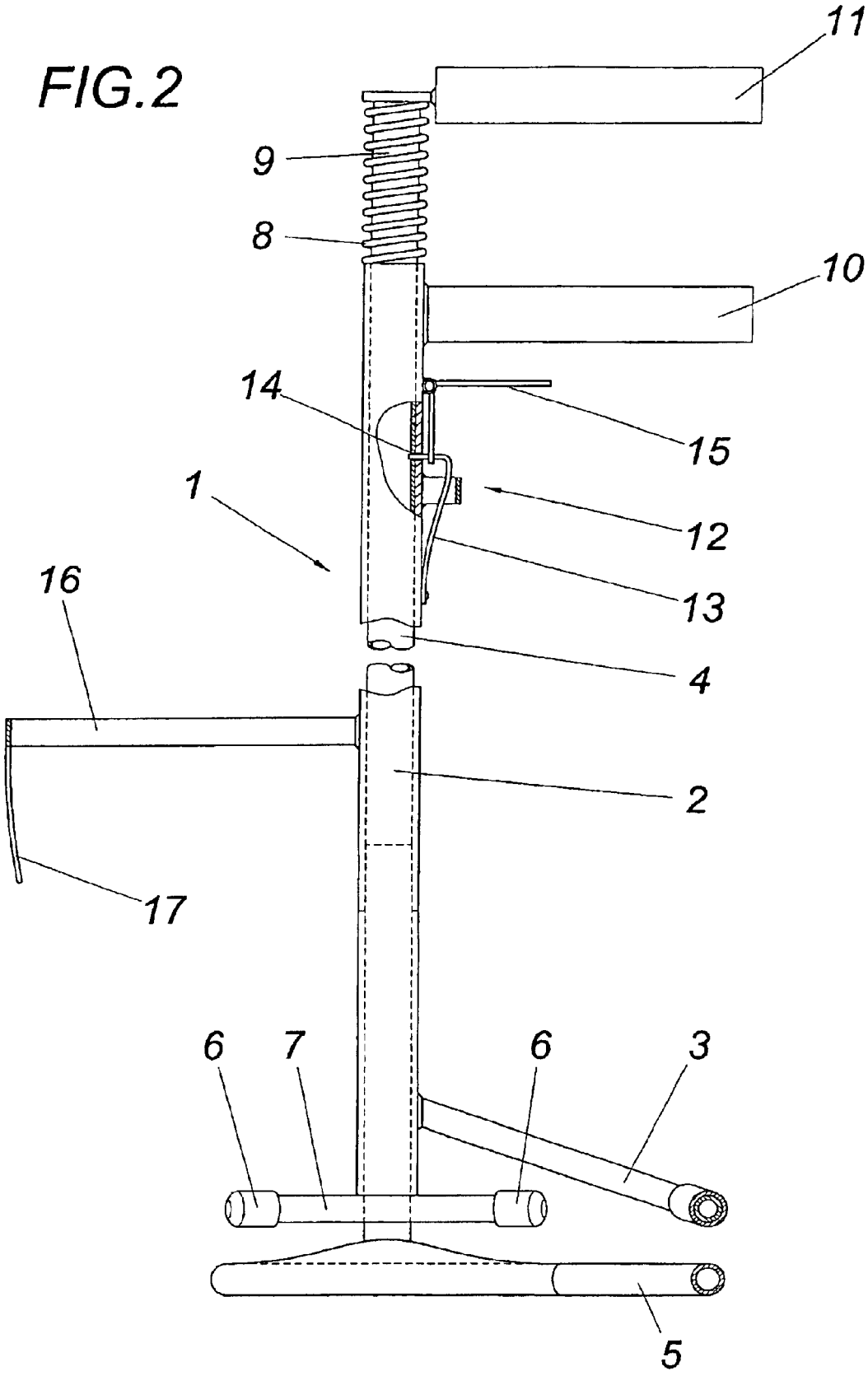
FIG. 2 shows a sectional view along line II—II in FIG. 1.

The apparatus for putting on a stocking according to FIGS. 1 and 2 comprises a frame 1 forming two lateral longitudinal rods 2 which are mutually rigidly connected by means of a U-shaped clamping member 3. Actuating rods 4 are held in a longitudinally displaceable way along said longitudinal rods 2, which actuating rods are in connection via a stretching member 5. The stretching member 5 forms a clamping device with the clamping member 3, with clamping jaws being obtained via elastic supports 6 on one side of the clamping member 3 and on the other side of clamping webs 7 in the region of the longitudinal rods 4, which clamping jaws tightly clamp a stocking pulled over the stretching member 5 on the stretching member 5. This clamping is achieved by the clamping force of locking springs 8 which enclose the end sections 9 of the actuating rods 4 projecting over the longitudinal rods 2 and rest on the face side on the longitudinal rods 2. Said longitudinal rods 2 are formed in the embodiment at rectangular tubes which receive the actuating rods 4.

On the side of the frame 1 which is averted from the opening side of the U-shaped stretching member 5, handle parts 10 and 11 are provided at the upper ends of both the longitudinal rods 2 as well as the actuating rods 4, which handle parts are combined into a handle and are used not only for guiding the frame 1 but also for opening the clamping device against the clamping force of the locking springs 8. For this purpose the handle parts 10 and 11 of the two handles which are enclosed by a hand each merely need to be pulled against each other, so that the projecting end section 9 of the actuating rods 4 are inserted into the hollow longitudinal rods 2, leading to a lift-off of the stretching member 5 from the clamping jaws 6 of the clamping member 3 and the clamping webs 7.

In order to ensure the opened position of the clamping device for the purpose of an unhindered stretching of a stocking on the stretching member 5, a latching device 12 is provided which consists of a resilient hook 13 each held on the longitudinal rods 2, which hook engages in a latching recess 14 of the associated actuating rod 4 and thus locks the actuating rods 4 relative to the longitudinal rods 2 in the opened position of the clamping device. For the purpose of releasing said latched position, there is an unlatching lever 15 which is held on the same in the handle region below the handle part 10 for the longitudinal rod 2 and, when swiveled, withdraws the resilient hook 13 from the latching recess 14 of the actuating rod 4, leading to a closure of the clamping device through the locking springs 8. For the purpose of releasing the clamping thus achieved of the stocking stretched on the stretching member 5, the handle parts 10 and 11 must be pulled towards each other in the manner as already described until the resilient hook 13 latches into the latching recess 14 again.

In order to provide an aid for removing the stocking with the frame 1, the longitudinal rods 2 are connected on the side averted from the clamping member 3 by a U-shaped connecting member 16 which carries in the middle a downwardly facing driver 17. Said driver 17 can be introduced on the calf side of the leg into the worn stocking in order to withdraw said stocking via the heel from the foot.

Figure 3:
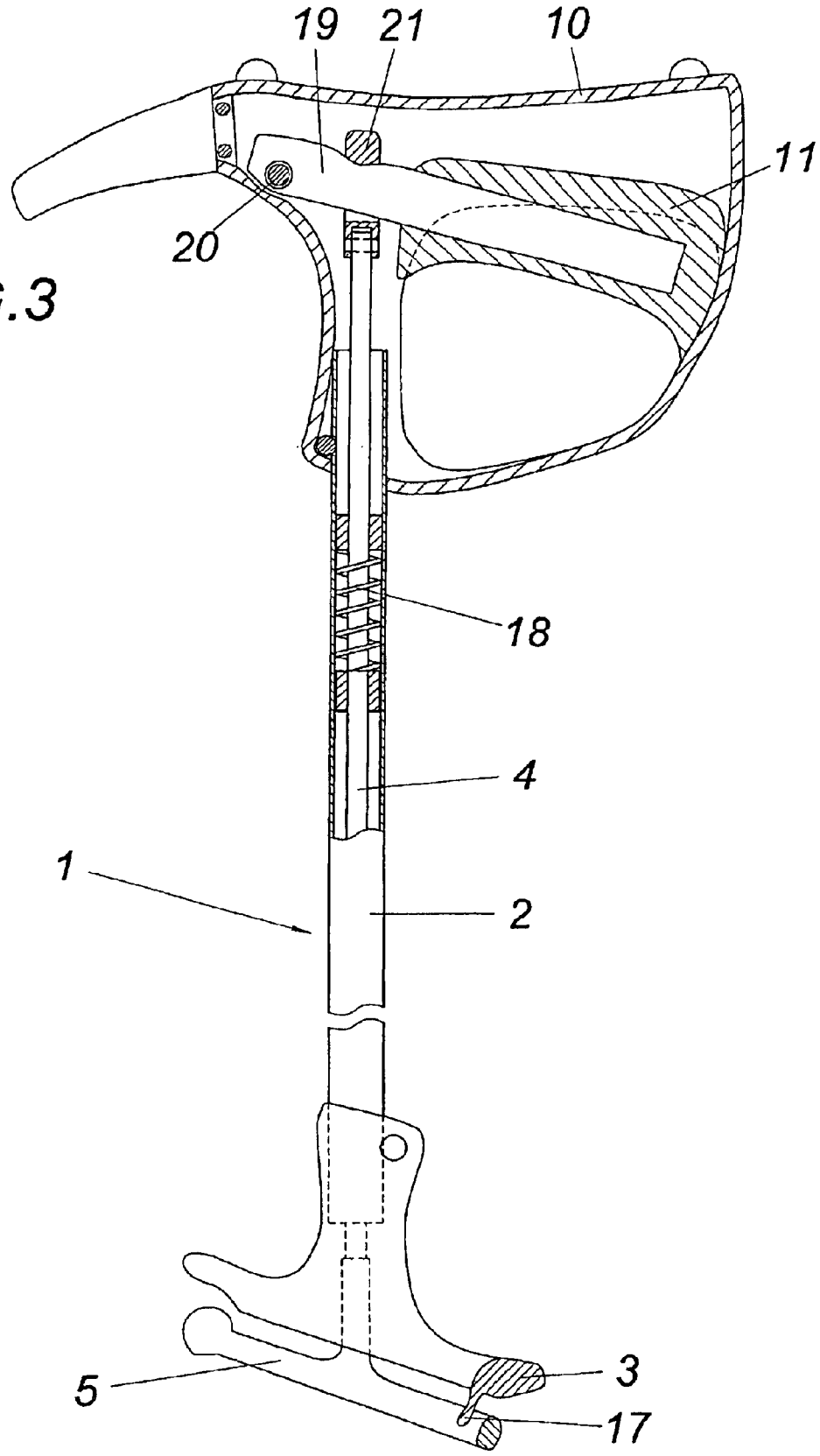
FIG. 3 shows a constructional variant of an apparatus in accordance with the invention in a longitudinal sectional view.

In contrast to the embodiment according to FIGS. 1 and 2, the clamping device is pressurized by opening springs 18 according to the embodiment of FIG. 3, which opening springs are arranged in the hollow longitudinal rods 2 and which load the actuating rods 4 in such a way that the stretching member 5 is lifted off from the clamping member 3, as is shown in FIG. 3. For the purpose of actuating the clamping device there is a handle made of two handle parts 10 and 11. Whereas the handle part 10 is rigidly connected with the longitudinal rods 2, the handle part 11 forms a pivoting lever 19 which is pivotably held on the handle part 10 via a link axle 20 and is connected with the respective actuating rod 4 via an eye 21 which is penetrated by the pivoting lever 19. The pivoting lever 19 which is pulled via the opening spring 18 to a downwardly swiveled stop position can be swiveled up via the handle part 11 against the handle part 10, leading to a retraction of the actuating rods 4 into the longitudinal rods 2 with the consequence that the stretching member 5 is pressed in a clamping way against the clamping member 3. A stocking pulled over the stretching member 5 is thus tightly clamped between the stretching member 5 and the clamping member 3 and can be slipped in a simple way with the help of the apparatus over a foot grasping between the longitudinal rods 2.

For the purpose of removing the stocking, a removal aid in the form of a downwardly facing driver 17 can be provided on the clamping member 3, which driver can be introduced on the calf side of the leg into the stocking, so that the stocking can be removed from the foot via the heel when the frame I is guided in a respective manner.

What is claimed is:

1. An apparatus for putting on a stocking with a frame (1) made of two longitudinal rods (2) which are provided at one upper end with handles and with a U-shaped stretching member (5) for receiving the stocking between the lower ends of the longitudinal rods (2), characterized in that the stretching member (5) is part of a clamping device which consists of two clamping parts, namely the lower stretching member (5) and an upper clamping member (3) cooperating with the lower stretching member (5), and that one clamping part mutually connects the two longitudinal rods (2) and the other of the two clamping parts mutually connects two actuating rods (4) which are displaceable along the longitudinal rods (2) against the force of a spring.

2. An apparatus as claimed in claim 1, characterized in that the actuating rods (4) which are displaceably held in the hollow longitudinal rods (2) carry the stretching member (5) between their lower ends projecting beyond the longitudinal rods (2).

3. An apparatus as claimed in claim 1, characterized in that the longitudinal rods (2) and the actuating rods are provided on the side averted from the opening of the U-like stretching member (5) with transversally aligned handle parts (10, 11) which are associated in pairs to a handle for actuating the clamping device.

4. An apparatus as claimed in claim 2, characterized in that the actuating rods (4) are pressurized by locking springs (8) which enclose an end section (9) projecting beyond the upper end of the longitudinal rods (2) and rest on the face side of the longitudinal rods (2).

5. An apparatus as claimed in claim 4, characterized in that the clamping device can be latched in its open position by a latching device (12) which consists of resilient hooks (13) which are held on the longitudinal rods (2) and engage in a latching recess (14) of the actuating rods (4).

6. An apparatus as claimed in claim 2, characterized in that the actuating rods (4) are pressurized by opening springs and that the handle parts (11) belonging to the actuating rods (4) are arranged below the handle parts (10) of the longitudinal rods (2).

7. An apparatus as claimed in claim 1, characterized in that the two longitudinal rods (2) carry a U-shaped connecting member (16) at a distance above the clamping member (3) and opposite of the same, on which connecting member there is provided in the middle a downwardly facing driver (17) as a removal aid for the stocking.

8. An apparatus as claimed in claim 1, characterized in that a downwardly facing driver (17) is provided as a removal aid for the stocking on the stretching member (5) or on the clamping member (3) in the region of a web mutually joining the two member legs.

9. An apparatus as claimed in claim 1, characterized in that the stretching member (5) and the clamping member (3) extend upwardly in an inclined manner with the member opening relative to the longitudinal rods (2) and the actuating rods (4).

* * * * *